US010420391B2

(12) United States Patent
Barnes et al.

(10) Patent No.: US 10,420,391 B2
(45) **Date of Patent: *Sep. 24, 2019**

(54) ARTICLE OF FOOTWEAR WITH SUPPORT ASSEMBLY HAVING PRIMARY AND SECONDARY MEMBERS

(71) Applicant: NIKE, Inc., Beaverton, OR (US)

(72) Inventors: Elizabeth Barnes, Beaverton, OR (US); Margarita Cortez, Beaverton, OR (US); Zachary Elder, Beaverton, OR (US); Fred Fagergren, Beaverton, OR (US); Lee Peyton, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 220 days.

This patent is subject to a terminal disclaimer.

(21) Appl. No.: 15/339,136

(22) Filed: Oct. 31, 2016

(65) Prior Publication Data

US 2017/0042287 A1 Feb. 16, 2017

Related U.S. Application Data

(63) Continuation of application No. 13/956,711, filed on Aug. 1, 2013, now Pat. No. 9,480,298.

(51) Int. Cl.

| | |
|---|---|
| ***A43B 7/14*** | (2006.01) |
| ***A43B 13/04*** | (2006.01) |
| ***A43B 13/18*** | (2006.01) |
| ***A43B 13/12*** | (2006.01) |
| ***A43B 17/00*** | (2006.01) |
| ***A43B 17/02*** | (2006.01) |

(52) U.S. Cl.

CPC ..... *A43B 13/186* (2013.01); *A43B 7/144* (2013.01); *A43B 7/148* (2013.01); *A43B 7/1425* (2013.01); *A43B 7/1445* (2013.01); *A43B 13/04* (2013.01); *A43B 13/125* (2013.01); *A43B 13/181* (2013.01); *A43B 13/188* (2013.01); *A43B 17/003* (2013.01); *A43B 17/02* (2013.01)

(58) Field of Classification Search

CPC ..... A43B 3/0057; A43B 3/0068; A43B 7/144; A43B 7/148; A43B 7/1425; A43B 7/1445; A43B 13/04; A43B 13/125; A43B 13/181; A43B 13/188; A43B 17/003; A43B 17/02

USPC ..... 36/87

See application file for complete search history.

(56) References Cited

U.S. PATENT DOCUMENTS

| | | | |
|---|---|---|---|
| 1,202,732 | A | 10/1916 | Keogh |
| 2,580,840 | A | 1/1952 | Rogndal |
| 3,036,389 | A | 5/1962 | Wesch |
| 3,159,249 | A | 12/1964 | Lanzan |
| 4,535,553 | A | 8/1985 | Derderian et al. |
| 4,592,153 | A | 6/1986 | Jacinto |
| 4,638,577 | A | 1/1987 | Riggs |
| 4,707,934 | A | 11/1987 | Hart |
| 4,774,774 | A | 10/1988 | Allen, Jr. |
| 5,060,401 | A | 10/1991 | Whatley |

(Continued)

*Primary Examiner* — Anne M Kozak

(74) *Attorney, Agent, or Firm* — Banner & Witcoff, Ltd.

(57) ABSTRACT

An article of footwear includes an upper, a midsole, and a support assembly positioned beneath the midsole. The support assembly includes a plurality of primary support members having a substantially Z-shaped cross-section extending transversely across the support assembly. The support assembly may include a plurality of secondary support members having an inverted V-shaped cross-section, extending longitudinally along the support assembly, and intersecting with the primary support members. An outsole is positioned beneath the support assembly.

19 Claims, 6 Drawing Sheets

(56) References Cited

U.S. PATENT DOCUMENTS

| | | | |
|---|---|---|---|
| 5,224,279 | A | 7/1993 | Agnew |
| 5,279,051 | A | 1/1994 | Whatley |
| 5,337,492 | A | 8/1994 | Anderie et al. |
| 5,678,327 | A | 10/1997 | Halberstadt |
| 5,713,140 | A | 2/1998 | Baggenstoss |
| 5,937,544 | A | 8/1999 | Russell |
| 5,946,824 | A | 9/1999 | Tighe et al. |
| 6,195,915 | B1 | 3/2001 | Russell |
| 6,219,940 | B1 | 4/2001 | Kita |
| 6,305,100 | B1 | 10/2001 | Komarnycky et al. |
| 6,311,414 | B1 | 11/2001 | Kita |
| 6,314,664 | B1 | 11/2001 | Kita et al. |
| 6,327,795 | B1 | 12/2001 | Russell |
| 6,385,864 | B1 | 5/2002 | Sell, Jr. et al. |
| 6,763,611 | B1 | 7/2004 | Fusco |
| 6,842,999 | B2 | 1/2005 | Russell |
| D506,053 | S | 6/2005 | Cook |
| 6,964,119 | B2 | 11/2005 | Weaver, III |
| 7,128,796 | B2 | 10/2006 | Hensley et al. |
| 7,168,186 | B2 | 1/2007 | Russell |
| 7,181,866 | B2 | 2/2007 | Braunschweiler |
| 7,383,647 | B2 | 6/2008 | Chan et al. |
| 7,401,419 | B2 | 7/2008 | Lucas et al. |
| 7,475,497 | B2 | 1/2009 | Hoffer et al. |
| 7,549,236 | B2 | 6/2009 | Dillon et al. |
| D616,188 | S | 5/2010 | Chan |
| 7,779,558 | B2 | 8/2010 | Nishiwaki et al. |
| 7,877,900 | B2 | 2/2011 | Russell |
| D634,524 | S | 3/2011 | Pauk et al. |
| D634,922 | S | 3/2011 | Pauk et al. |
| 7,950,169 | B2 | 5/2011 | Holt et al. |
| 8,151,485 | B2 | 4/2012 | Hurd et al. |
| 8,181,365 | B2 | 5/2012 | Cass et al. |
| 8,192,828 | B2 | 6/2012 | Greene et al. |
| D691,787 | S | 10/2013 | Callahan et al. |
| 8,732,984 | B2 | 5/2014 | Ha |
| D713,134 | S | 9/2014 | Hardigan et al. |
| 8,914,998 | B2 | 12/2014 | Gheorghian et al. |
| D722,426 | S | 2/2015 | Davis et al. |
| 8,978,272 | B2 | 3/2015 | Hurd et al. |
| 9,015,962 | B2 | 4/2015 | Boudreau et al. |
| 2001/0010129 | A1 | 8/2001 | Russell |
| 2005/0283998 | A1 | 12/2005 | Russell |
| 2006/0156580 | A1 | 7/2006 | Russell |
| 2007/0199213 | A1 | 8/2007 | Campbell et al. |
| 2009/0211114 | A1 | 8/2009 | Ivester et al. |
| 2011/0016746 | A1 | 1/2011 | Callahan et al. |
| 2011/0016749 | A1 | 1/2011 | Callahan et al. |
| 2012/0167416 | A1 | 7/2012 | Christensen et al. |
| 2013/0247425 | A1 | 9/2013 | Davis et al. |
| 2013/0326905 | A1 | 12/2013 | Vattes et al. |
| 2014/0115920 | A1 | 5/2014 | McCue |

ARTICLE OF FOOTWEAR WITH SUPPORT ASSEMBLY HAVING PRIMARY AND SECONDARY MEMBERS

RELATED APPLICATIONS

This application is a continuation of application Ser. No. 13/956,711, filed on Aug. 1, 2013, which is entirely incorporated herein by reference.

FIELD

Aspects of this invention relate generally to an article of footwear with an improved support assembly and, in particular, to an article of footwear having a support assembly with primary members and secondary members.

BACKGROUND

Conventional articles of athletic footwear generally include two primary elements, an upper and a sole structure. The upper is secured to the sole structure and forms a void on the interior of the footwear for comfortably and securely receiving a foot. The sole structure is secured to a lower portion of the upper and is positioned between the foot and the ground. The sole structure generally incorporates multiple layers that are conventionally referred to as an insole, a midsole, and an outsole. The insole, or sockliner, is a thin, compressible member located within the void and proximate a lower surface of the foot to enhance footwear comfort.

The outsole forms a ground-engaging portion (or other contact surface-engaging portion) of the sole structure, and is formed from a durable and wear-resistant material that includes texturing to improve traction.

To keep a wearer safe and comfortable, footwear is called upon to perform a variety of functions. For example, the sole structure of footwear should provide adequate support and impact force attenuation properties to prevent injury and reduce fatigue, while at the same time provide adequate flexibility so that the sole structure articulates, flexes, stretches, or otherwise moves to allow an individual to fully utilize the natural motion of the foot.

The midsole, which is conventionally secured to the upper along the length of the upper, forms a middle layer of the sole structure and is primarily responsible for attenuating ground (or other contact surface) reaction forces to lessen stresses upon the foot and leg, may also beneficially utilizing such ground reaction forces for more efficient toe-off, and control potentially harmful foot motions, such as over pronation. Conventional midsoles may include a foam material to attenuate impact forces and absorb energy when the footwear contacts the ground during athletic activities. Other midsoles may utilize fluid-filled bladders (e.g., filled with air or other gasses) to attenuate impact forces and absorb energy.

Although foam materials in the midsole succeed in attenuating impact forces for the foot, foam materials that are relatively soft may also impart instability that increases in proportion to midsole thickness. For example, the use of very soft materials in the midsole of running shoes, while providing protection against vertical impact forces, can encourage instability of the ankle, thereby contributing to the tendency for over-pronation. This instability has been cited as a contributor to "runner's knee" and other athletic injuries. For this reason, footwear design often involves a balance or tradeoff between impact force attenuation and stability.

Stabilization is also a factor in sports like basketball, volleyball, football, and soccer. In addition to running, an athlete may be required to perform a variety of motions including transverse movement; quickly executed direction changes, stops, and starts; movement in a backward direction; and jumping. While making such movements, footwear instability may lead to excessive inversion or eversion of the ankle joint, potentially causing an ankle sprain.

High-action sports, such as soccer, basketball, football, rugby, ultimate, etc., impose special demands upon players and their footwear. Accordingly, it would be desirable to provide footwear that achieves better dynamic control of the wearer's movements, while at the same time providing impact-attenuating features that protect the wearer from excessive impact loads.

It would be desirable to provide an article of footwear with a support assembly that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide an article of footwear with a support assembly providing improved shock-attenuation and energy-absorption. In accordance with a first aspect, an article of footwear includes an upper, a midsole, and a support assembly positioned beneath the midsole. The support assembly includes a plurality of primary support members having a substantially Z-shaped cross-section extending transversely across the support assembly, and a plurality of secondary support members having an inverted V-shaped cross-section, extending longitudinally along the support assembly, and intersecting with the primary support members. An outsole is positioned beneath the support assembly.

In accordance with another aspect, an article of footwear includes an upper, and a midsole including a first midsole portion extending from beneath a heel portion of the upper to a midfoot portion of the upper, and a second midsole portion extending from beneath a forefoot portion of the upper to the midfoot portion of the upper. A support assembly is positioned beneath the first midsole portion and includes a plurality of primary support members having a substantially Z-shaped cross-section and extending transversely across the support assembly and substantially parallel to one another. A plurality of secondary support members have an inverted V-shaped cross-section, extending longitudinally along the support assembly and substantially parallel to one another, and intersect with the primary support members. An outsole is positioned beneath the support assembly and the second midsole portion.

In accordance with a further aspect, an article of footwear including an upper and a midsole including a first midsole portion extending from beneath a heel portion of the upper to a midfoot portion of the upper and including a base portion and a peripheral wall extending upwardly from a periphery of the base portion, and a second midsole portion extending from beneath a forefoot portion of the upper to the midfoot portion of the upper. A support assembly is positioned beneath the midsole and includes a plurality of primary support members having a substantially Z-shaped cross-section and extends transversely across the support assembly and substantially parallel to one another. A plurality of secondary support members have an inverted V-shaped cross-section, extend longitudinally along the support assembly and substantially parallel to one another, and intersect with the primary support members. An outsole has a first portion positioned beneath the support assembly and a second portion positioned beneath the second midsole portion. The primary support members are of unitary construction with the secondary support members.

By providing an article of footwear with a support assembly having primary and secondary members, the footwear is provided with improved shock-attenuation and energy-absorption. These and additional features and advantages disclosed here will be further understood from the following detailed disclosure of certain embodiments.

Figure 1:
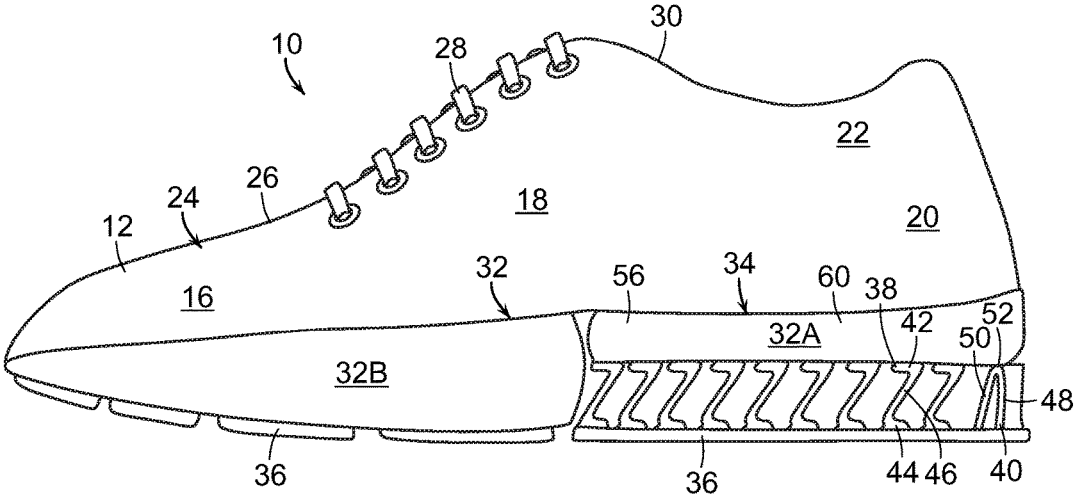
FIG. 1 is an elevation view of an article of footwear having a support assembly including a plurality of primary support members and a plurality of secondary support members.

The figures referred to above are not drawn necessarily to scale, should be understood to provide a representation of particular embodiments of the invention, and are merely conceptual in nature and illustrative of the principles involved. Some features of the footwear with a support assembly having primary and secondary support members depicted in the drawings have been enlarged or distorted relative to others to facilitate explanation and understanding. The same reference numbers are used in the drawings for similar or identical components and features shown in various alternative embodiments. Footwear with a support assembly having primary and secondary support members as disclosed herein would have configurations and components determined, in part, by the intended application and environment in which they are used.

DETAILED DESCRIPTION OF CERTAIN PREFERRED EMBODIMENTS

The following discussion and accompanying figures disclose articles of footwear having sole structures with sole geometries in accordance with various embodiments of the present disclosure. Concepts related to the sole geometry are disclosed with reference to a sole structure for an article of athletic footwear. The disclosed sole structure may be incorporated into a wide range of athletic footwear styles, including shoes that are suitable for rock climbing, bouldering, hiking, running, baseball, basketball, cross-training, football, rugby, tennis, volleyball, and walking, for example. In addition, sole structures according to various embodiments as disclosed herein may be incorporated into footwear that is generally considered to be non-athletic, including a variety of dress shoes, casual shoes, sandals, slippers, and boots. An individual skilled in the relevant art will appreciate, given the benefit of this specification, that the concepts disclosed herein with regard to the sole structure apply to a wide variety of footwear styles, in addition to the specific styles discussed in the following material and depicted in the accompanying figures As used herein, the terms "upper," "lower," "top," "bottom," "upward," "downward," "vertical," "horizontal," "longitudinal," "transverse," "front," "back," "forward," "rearward," etc., unless otherwise defined or made clear from the disclosure, are relative terms meant to place the various structures or orientations of the structures of the article of footwear in the context of an article of footwear worn by a user standing on a flat, horizontal surface. "Transverse" refers to a generally sideways (i.e., medial-to-lateral or heel-to-toe) orientation (as opposed to a generally vertical orientation). "Lateral" refers to a generally medial-to-lateral (i.e., side-to-side) transverse orientation. "Longitudinal" refers to a generally heel-to-toe (i.e., front-to-back) transverse orientation. A "lateral roll" is characterized by upward and/or downward displacement of a medial side of the footwear relative to a lateral side of the footwear. A "longitudinal roll" is characterized by upward and/or downward displacement of a forward side of the footwear relative to a rearward side of the footwear.

An article of footwear 10 is depicted in FIG. 1 as including an upper 12 and a sole assembly 14. For purposes of reference in the following description, footwear 10 may be divided into three general regions: a forefoot region 16, a midfoot region 18, and a heel region 20. Regions 16-20 are not intended to demarcate precise areas of footwear 10. Rather, regions 16-20 are intended to represent general areas of footwear 10 that provide a frame of reference during the following discussion. Although regions 16-20 apply generally to footwear 10, references to regions 16-20 also may apply specifically to upper 12, sole assembly 14, or individual components within either upper 12 or sole assembly 14.

Upper 12 defines a void or chamber for receiving a foot. For purposes of reference, upper 12 includes a lateral side 22, an opposite medial side 24, and a vamp or instep area 26. Lateral side 22 is positioned to extend along a lateral side of the foot (i.e., the outside) and generally passes through each of regions 16-20. Similarly, medial side 24 is positioned to extend along an opposite medial side of the foot (i.e., the inside) and generally passes through each of regions 16-20. Upper 12 may also include a closure mechanism, such as lace 28. Upper 12 also includes an ankle opening 30 that provides the foot with access to the void within upper 12.

Upper 12 may also include an insole (or sockliner, not shown), which is generally a thin, compressible member located within the void for receiving the foot and proximate to a lower surface of the foot. Typically, the insole, which is configured to enhance footwear comfort, may be formed of foam, and optionally a foam component covered by a moisture wicking fabric or textile material. Further, the insole or sockliner may be glued or otherwise attached to the other components of footwear 10, although it need not be attached, if desired.

Sole assembly 14 includes a midsole 32 positioned below upper 12. Midsole 32 may be formed of a resilient, polymer foam material, such as polyurethane or ethylvinylacetate ("EVA"). Other suitable materials for midsole 32 will become readily apparent to those skilled in the art, given the benefit of this disclosure. In certain embodiments, it is to be appreciated that midsole 32 may incorporate sealed chambers, fluid-filled bladders.

Midsole 32 may be directly secured to upper 12 with an adhesive, for example. Suitable adhesives are well known in the art and need not be discussed in greater detail here. Midsole 32 may be secured to upper 12 with any other suitable fastening means, and such other suitable means of midsole 32 to upper 12 will become readily apparent to those skilled in the art, given the benefit of this disclosure.

Midsole 32 may extend beneath the length and width of upper 12. In the illustrated embodiment, midsole 32 includes a first midsole portion 32A extending from heel portion 20 forwardly beneath midfoot portion 18, and a second midsole portion 32B extending from forefoot portion 16 rearwardly beneath midfoot portion to a point adjacent first midsole portion 32A.

A support assembly 34 is positioned below midsole 32. Support assembly 34 serves to provide shock-attenuation and energy-absorption for footwear 10. In the embodiment illustrated here, support assembly 34 extends from heel portion 20 to midfoot portion 18, beneath first midsole portion 32A. It is to be appreciated that support assembly 34 can extend beneath the entirety of midsole 32 and upper 12 or any portions thereof. It is to be further appreciated that support assembly 34 could include two or more separate portions positioned at any desired location along footwear 10.

An outsole 36 is positioned below support assembly 34 as well as below midsole 32 in forefoot portion 16. Outsole 36 may be secured to support assembly 34 and midsole 32 with an adhesive, for example. Suitable adhesives are well known in the art and need not be discussed in greater detail here. Other suitable means of fastening outsole 36 to support assembly 34 and midsole 32 will become readily apparent to those skilled in the art, given the benefit of this disclosure.

Suitable materials for outsole 36 include any of the conventional rubber materials that are utilized in footwear outsoles, such as carbon black rubber compound. Other suitable materials for outsole 36 will become readily apparent to those skilled in the art, given the benefit of this disclosure.

In certain embodiments, outsole 36 may be formed of a single layer of material secured to and extending over the bottom surface of each of support assembly 34 and midsole 32. In other embodiments, outsole 36 may be formed of a plurality of individual elements secured to the bottom surface of each of support assembly 34 and midsole 32.

Support assembly 34 includes a plurality of primary support members 38 and a plurality of secondary support members 40. Primary support members 38 extend substantially laterally or transversely across support assembly 34, between lateral side 22 and medial side 24. Primary support members 38 have a substantially Z-shaped cross-section when viewed from one of lateral side 22 and medial side 24. Consequently, they have a reverse Z-shaped cross-section when viewed from the other of lateral side 22 and medial side 24. In the illustrated embodiment, primary support members 38 are substantially Z-shaped when viewed from lateral side 22. In the illustrated embodiment, primary support members 38 extend substantially parallel to one another laterally across support assembly 34. It is to be appreciated that primary support members 38 need not be substantially parallel to one another, as discussed below in greater detail.

Primary support members 38 include an upper member 42 and a lower member 44 spaced from upper member 42, each of which is substantially planar, substantially parallel to the other, and extends across support assembly 34. A central member 46 extends from one end of upper member 42, diagonally downwardly to an opposite end of lower member 44, thereby forming the substantially Z-shaped primary support member 38.

Secondary support members 40 have a substantially inverted V-shaped cross-section, and extend substantially longitudinally along support assembly 34, substantially parallel to one another. It is to be appreciated that secondary support members 40 need not be substantially parallel to one another in certain embodiments. In the illustrated embodiment, secondary support members 40 are substantially perpendicular to primary support members 38, and intersect with primary support members 38 throughout support assembly 34. Secondary support members 40 include a first leg 48 and a second leg 50, which are connected together at upper ends thereof, forming an apex or vertex 52 of the substantially inverted V-shape.

In the illustrated embodiment, support assembly 34 includes three secondary support members 40, and nine primary support members 38. It is to be appreciated that support assembly 34 can include more or fewer than three secondary support members 40 and nine primary support members 38.

Support assembly 34 serves to attenuate ground reaction forces, with primary support members 38 being primarily effective during compression loading and secondary support members 40 being primarily effective during shear loading.

Figure 3:
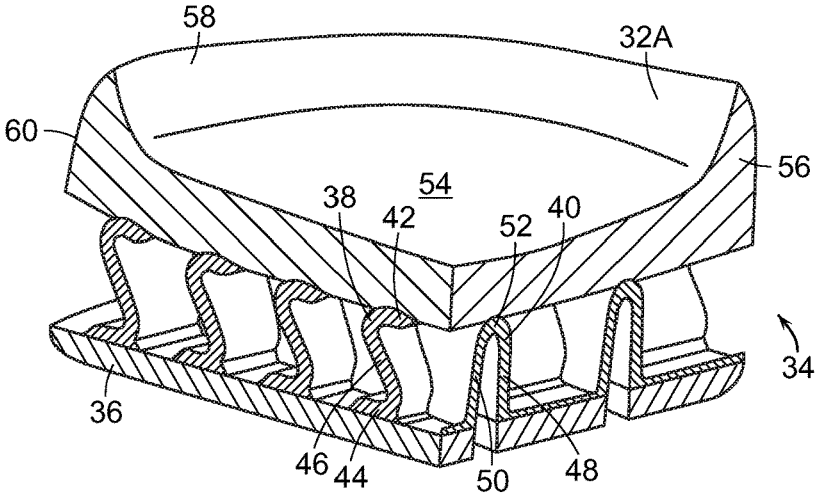
FIG. 3 is a perspective view, partially cut away, of a portion of the support assembly of FIG. 1, shown in a static condition.
Figure 4:
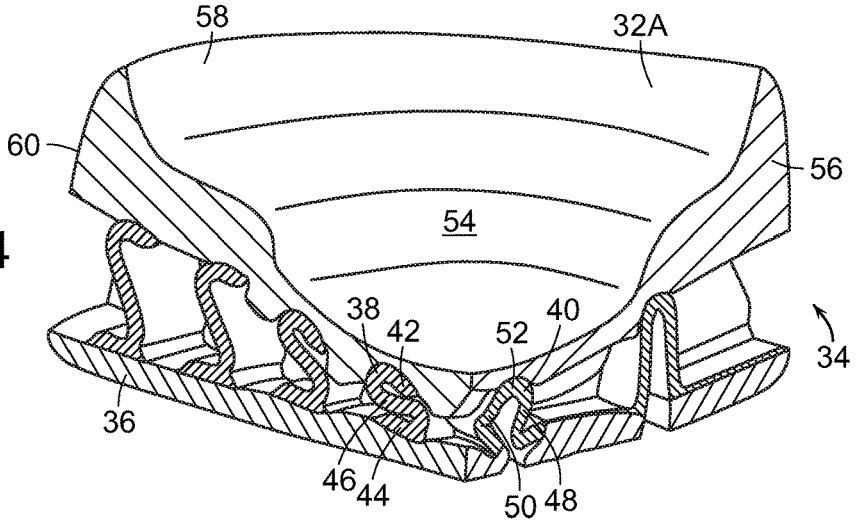
FIG. 4 is a perspective view, partially cut away, of a portion of the support assembly of FIG. 1, shown partially compressed.
Figure 5:
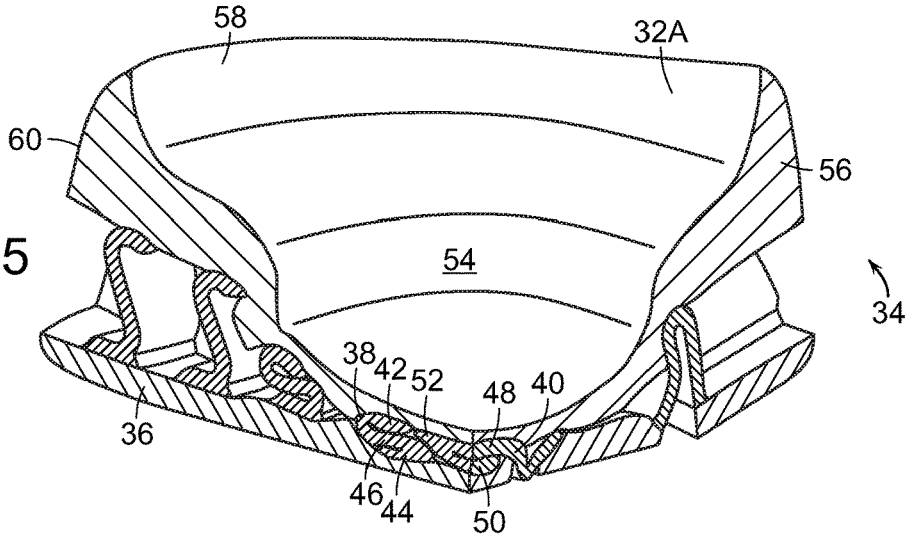
FIG. 5 is a perspective view, partially cut away, of a portion of the support assembly of FIG. 1, shown completely compressed.

The effect on primary support members 38 can be seen in FIGS. 3-5, where support assembly 34 is shown in a static condition, partially compressed, and completely compressed, respectively. As support assembly 34 is compressed, the substantially Z-shaped primary members 38 are compressed and flattened, such that each of upper member 42, lower member 44, and central member 46 extends substantially horizontally, as seen in FIG. 5.

Figure 6:
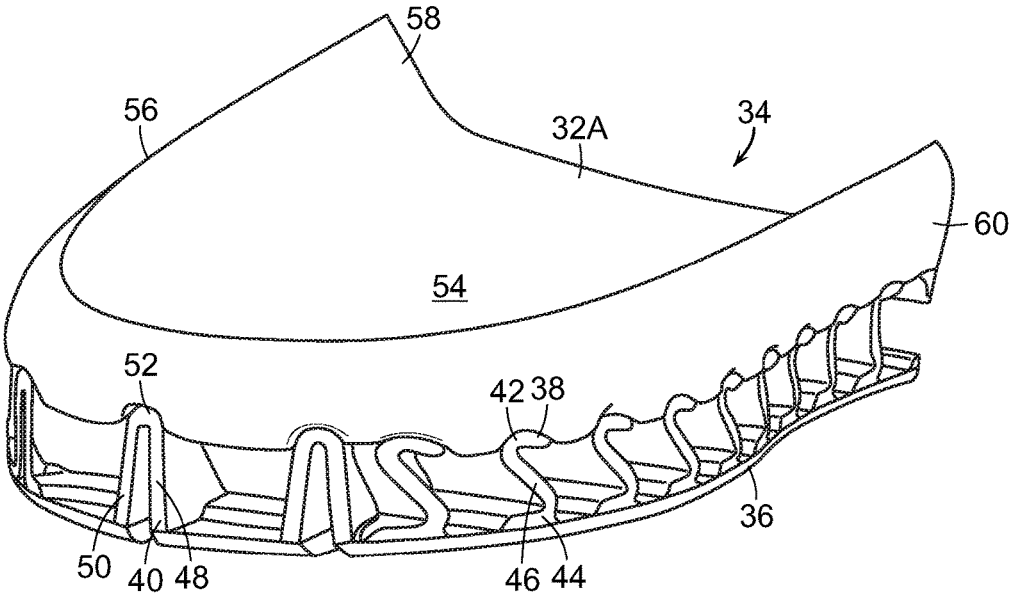
FIG. 6 is a perspective view of the support assembly of FIG. 1, shown partially compressed under a shear load.
Figure 7:
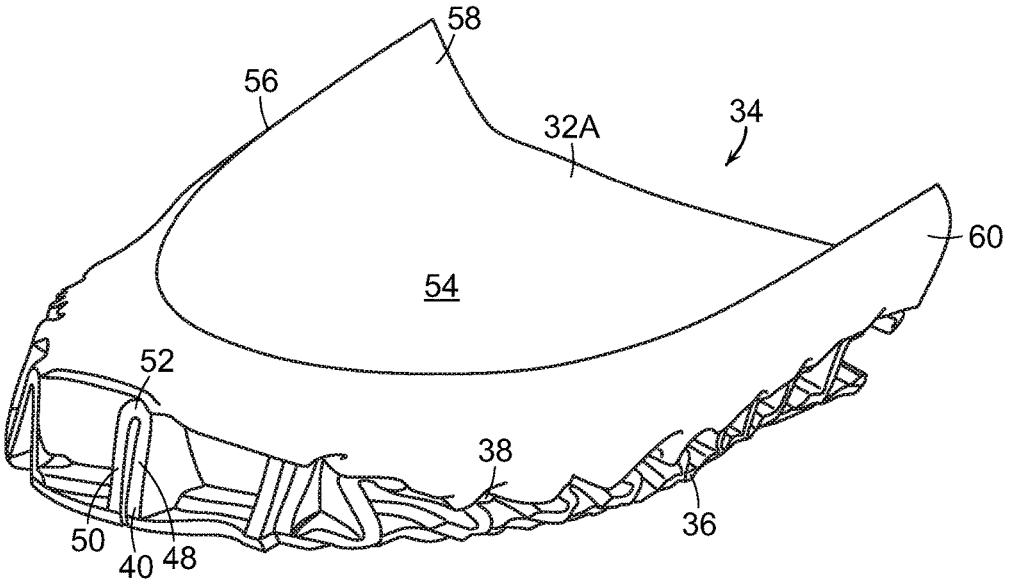
FIG. 7 is a perspective view of the support assembly of FIG. 1, shown completely compressed under a shear load.

The effect on secondary support members 40 can be seen in FIGS. 6-7, where support assembly 34 is shown under a partial shear load, and completely compressed under a shear load, respectively. As seen here, as support assembly 34 encounters a shear load, seen here as forcing support assembly to medial side 24 (to the right as seen here), secondary support members 40 partially collapse under a shear load such that first leg 48 and second leg 50 are pushed together to a point where they are substantially parallel, as seen in FIG. 7, and then may also tilt sideways under a greater shear load, as seen in FIG. 7.

In certain embodiments, support assembly 34 has a height H of between approximately 6 mm and approximately 22 mm, while in other embodiments between approximately 7 mm and approximately 12 mm, and in other embodiments between approximately 15 mm and approximately 20 mm.

In certain embodiments, primary support members 38 and secondary support members 40 of support assembly 34 are formed of unitary, that is one-piece, construction. That is, they are an entity made of a single material, as opposed to being formed from a plurality of parts secured together. Support assembly 34 may be formed in a mold, for example, in order to be formed of a single unitary material.

Primary support members 38 and secondary support members 40 of support assembly 34 may be formed of a polyether-block co-polyamide polymer, such as PEBAX®, available from Atofina Corporation of Puteaux, France, rubber, thermoplastic polyurethane (TPU), or a nylon, for example Nylon 12, which is often referred to as TR-90 Nylon, Nylon 6, or a fiber-filled nylon. Such nylons may be formed by selective laser sintering (SLS)®. SLS is an additive rapid manufacturing process that builds three dimensional parts by using a laser to selectively sinter (heat and fuse) a powdered material. The process begins with a 3D CAD file which is mathematically sliced into 2D cross-sections. The SLS prototype or part is built a layer at a time until completed. Laser sintering, and other rapid manufacturing processes are generally known in the art. One example system is found in U.S. Pat. No. 5,156,697 to Bourell et al. and is incorporated herein by reference.

Other suitable materials for support assembly 34 will become readily apparent to those skilled in the art, given the benefit of this disclosure.

As noted above, and seen in FIGS. 1-2, support assembly 34 extends beneath first midsole portion 32A and, therefore, extends from heel portion 20 to midfoot portion 18. It is to be appreciated that support assembly 34 can be positioned along any portion of footwear 10. Thus, support assembly 34 could extend along the entire length of footwear 10, or from forefoot portion 16 to midfoot portion 18. Support assembly 34 could, in certain embodiments, be formed of separate portions positioned at different points within footwear 10. Thus, for example, a first portion of support assembly 34 could be positioned in heel portion 20, with a second portion positioned in forefoot portion 16. It is to be appreciated that any number of portions of support assembly 34 could be provided and be positioned at any location within footwear 10.

Figure 2:
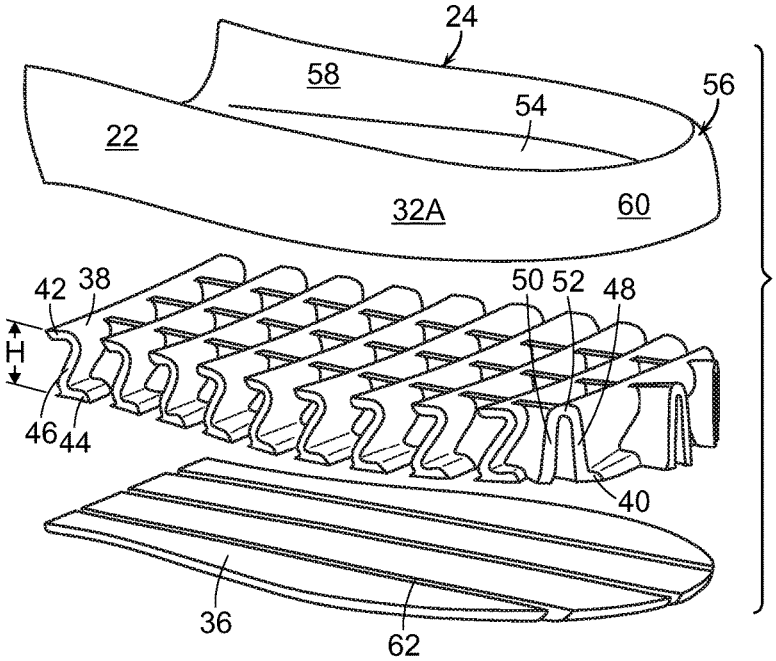
FIG. 2 is an exploded view of the support assembly of FIG. 1.

As seen in FIG. 2, first midsole portion 32A in includes a base portion 54 and a peripheral wall 56 extending upwardly from a periphery of base portion 54. Base portion 54 extends across a top surface of support assembly 34, contacting upper members 42. An interior surface 58 of peripheral wall 56 may be curved in a concave fashion so as to wrap about the portion of upper 12 received within first midsole portion 32A, while an exterior surface 60 of peripheral wall 56 may be curved in a convex fashion.

In certain embodiments, as illustrated in FIG. 2, a plurality of grooves 62 may be formed in an upper surface of outsole 36. In the illustrated embodiment, three grooves 62 extend longitudinally along outsole 36, each of which is positioned beneath a corresponding secondary support member 40.

Figure 8:
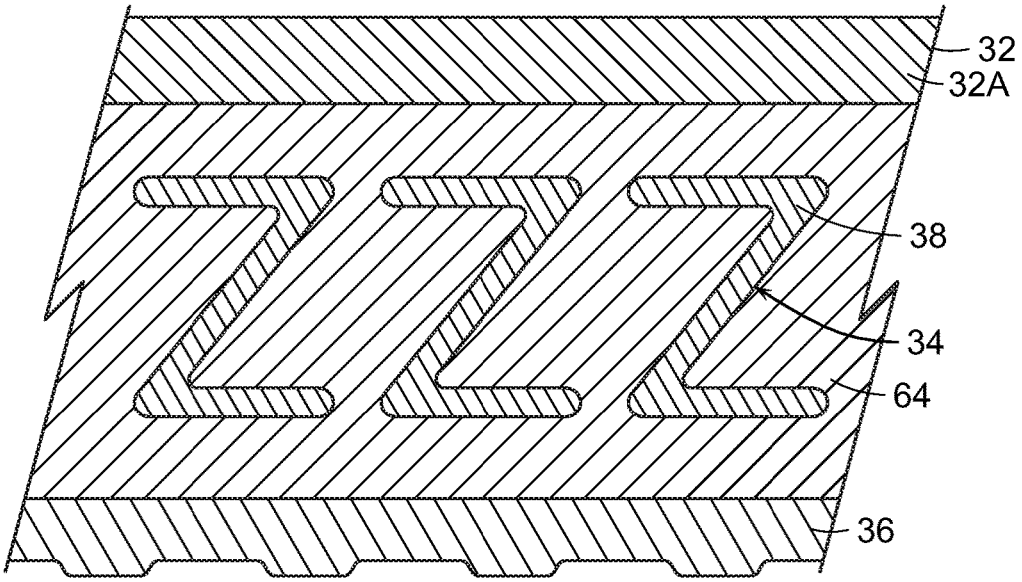
FIG. 8 is a section view of a portion of an alternative embodiment of the support assembly of FIG. 1, shown partially broken away.

In certain embodiments, as illustrated in FIG. 8, support assembly 34 may be encased within a layer of material 64. In the illustrated embodiment, material 64 is a layer positioned between midsole 32 and outsole 36. In certain embodiments, material 64 may be a foam, e.g., a polymer foam material, such as polyurethane or ethylvinylacetate ("EVA").

Figure 9:
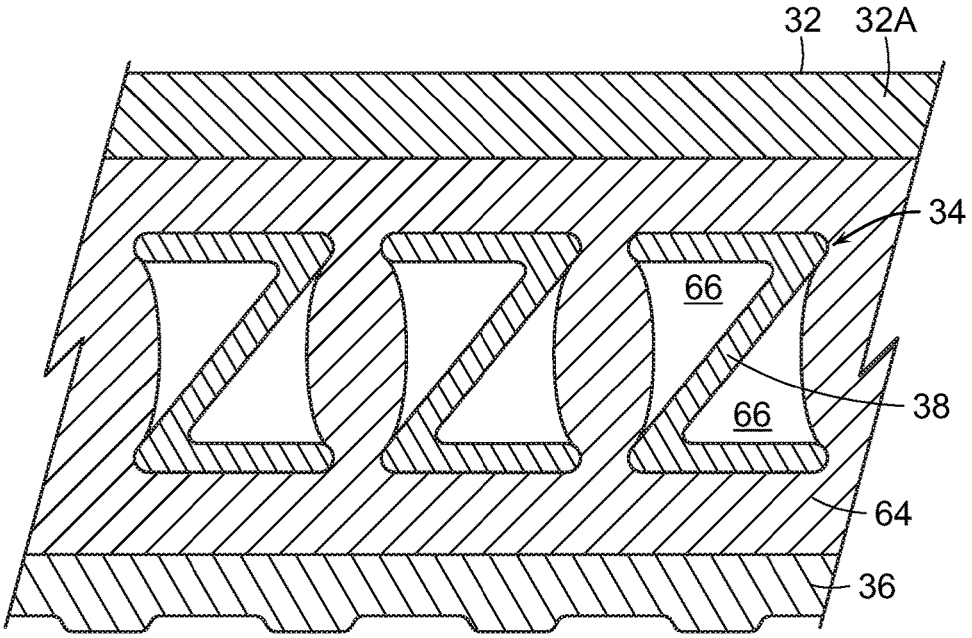
FIG. 9 is a section view of a portion of another alternative embodiment of the support assembly of FIG. 1, shown partially broken away.

As illustrated in FIG. 8, primary support member 38 can be seen to be completely encased within material 64. It is to be appreciated that in certain embodiments, as illustrated in FIG. 9, that a cavity 66 may be formed between sides of primary support member 38 and material 64.

Figure 10:
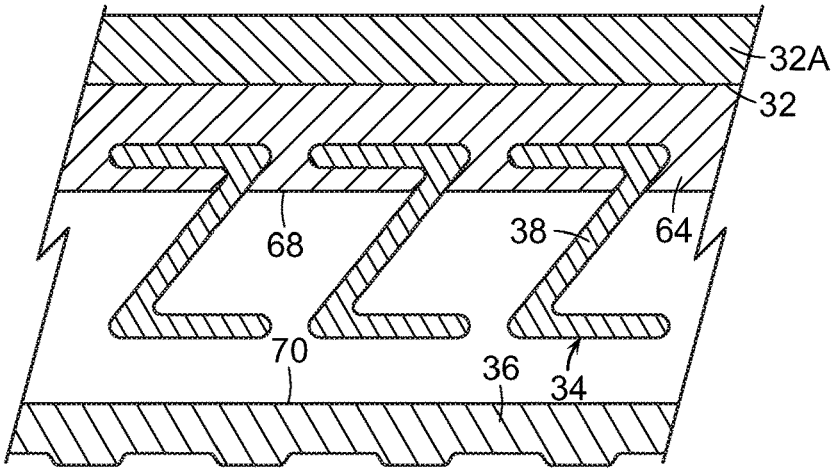
FIG. 10 is a section view of a portion of a further alternative embodiment of the support assembly of FIG. 1, shown partially broken away.
Figure 11:
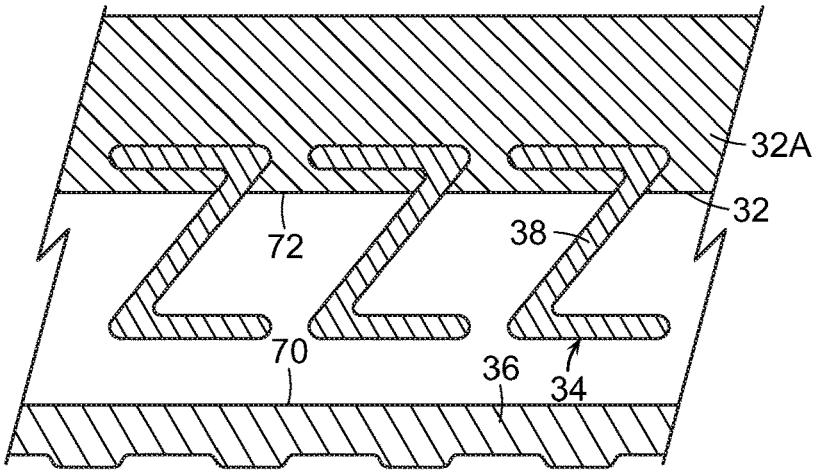
FIG. 11 is a section view of a portion of yet another alternative embodiment of the support assembly of FIG. 1, shown partially broken away.

In certain embodiments, as illustrated in FIG. 10, only an upper portion of support assembly 34 is encased within material 64. Thus, a lower portion of primary support member 38 of support assembly 34 is suspended between a lower surface 68 of material 64 and an upper surface 70 of outsole 36. In certain embodiments, as illustrated in FIG. 11, an upper portion of support assembly 34 may be encased within midsole 32, with the lower portion of support assembly suspended between a lower surface 72 of midsole 32 and upper surface 70 of outsole 36.

Figure 12:
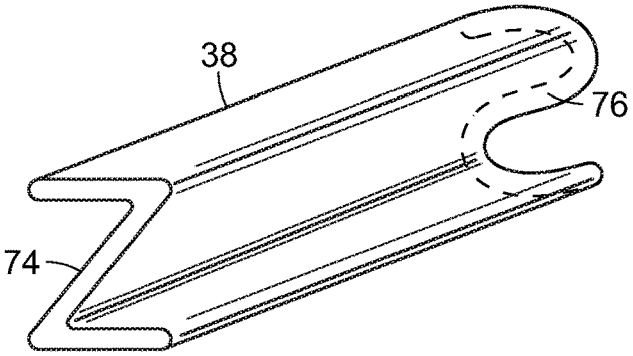
FIG. 12 is a perspective view of an alternative embodiment of a primary support member of the support assembly of FIG. 1.

In certain embodiments, as illustrated in FIG. 12, at least one primary support member 38 may transition from a Z-shaped cross-section at a first end 74 to an S-shaped cross-section at its opposed second end 76. It is also to be appreciated that at least one primary support member 38 may transition a mirror image of a Z-shape at first end 74 to a mirror image of an S-shape at second end 76.

Figure 13:
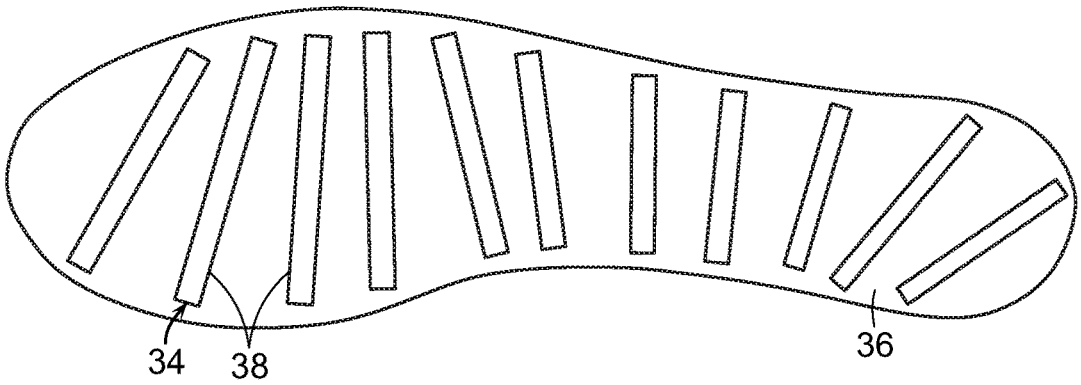
FIG. 13 is a plan view of an alternative embodiment of the support assembly of FIG. 1, with the primary support members shown with an outsole.

In certain embodiments, primary support members 38 of support assembly 34 extend substantially parallel to one another, as illustrated in FIGS. 1-7. In other embodiments, however, as illustrated in FIG. 13, primary support members 38 are angled with respect to one another. As illustrated here, primary support members 38 extend across substantially the entire width of outsole 36. It is to be appreciated that in certain embodiments, one or more of primary support members 38 may extend across only a portion of the width of outsole 36. In certain embodiments, some primary support members 38 could extend across substantially the entire width of outsole 36 while other primary support members 38 could extend across a smaller portion of the width of outsole 36.

Figure 14:
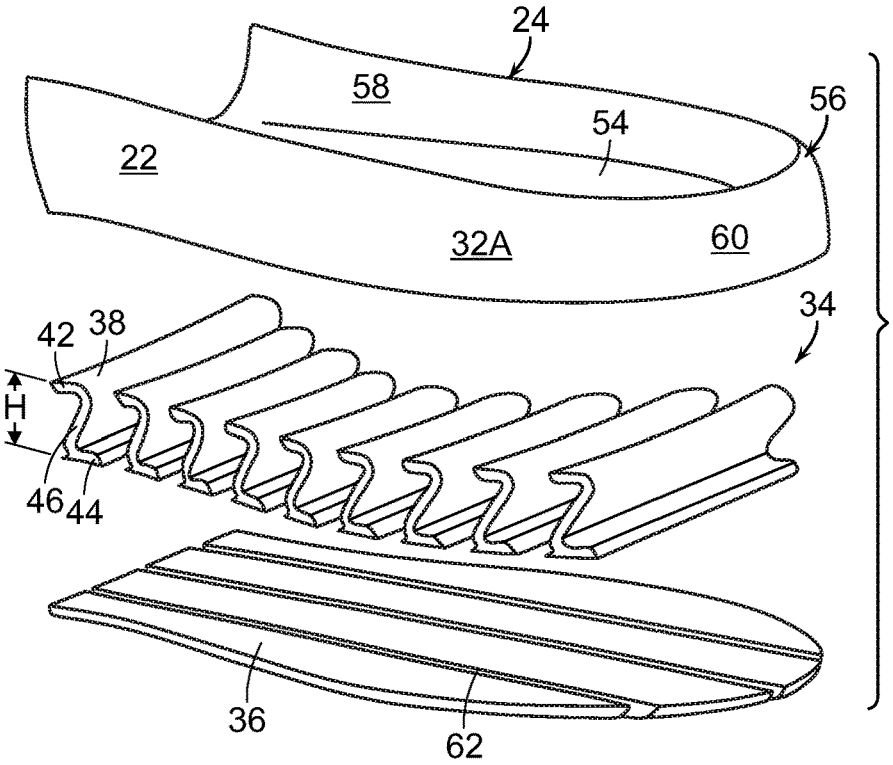
FIG. 14 is an exploded view of an alternative embodiment of the support assembly of FIG. 1.

In certain embodiments, as illustrated in FIG. 14, support assembly 34 may be formed of only primary support members 38, with no secondary support members. Additionally, as seen here, in certain embodiments, one or more primary support members 38 extends only partially across footwear 10, not completely across support assembly 34. It is to be appreciated that the lengths of different primary support members 38 can be optimized to improve performance, support, and comfort attributes of footwear 10.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:

an upper;

a midsole positioned beneath the upper;

a support assembly positioned beneath part of the midsole and comprising:

a plurality of primary support members extending transversely and continuously across the support assembly, at least one primary support member of the plurality of primary support members having one of a substantially Z-shaped cross-section and a substantially S-shaped cross-section;

a plurality of secondary support members having an inverted V-shaped cross-section extending longitudinally and continuously along the support assembly, and intersecting with the plurality of primary support members; and an outsole positioned beneath the support assembly.

2. The article of footwear of claim 1, wherein at least a portion of the at least one primary support member is encased in a layer of material.

3. The article of footwear of claim 2, wherein the layer of material is the midsole.

4. The article of footwear of claim 2, wherein the layer of material is a foam material.

5. The article of footwear of claim 1, wherein the at least one primary support member is encased in a layer of material.

6. The article of footwear of claim 5, further comprising a gap between an exterior surface of the at least one primary support member encased in the layer of material and an interior surface of the layer of material.

7. The article of footwear of claim 1, wherein the at least one primary support member transitions from a substantially Z-shaped cross-section at a first end thereof to a substantially S-shaped cross-section at a second end thereof.

8. The article of footwear of claim 1, wherein the midsole includes a base portion and a peripheral wall extending upwardly from a periphery of the base portion.

9. The article of footwear of claim 8, wherein the peripheral wall is curved so as to wrap about a portion of the upper.

10. The article of footwear of claim 1, further comprising a plurality of grooves formed in an upper surface of the outsole.

11. The article of footwear of claim 10, wherein the plurality of grooves includes three grooves.

12. The article of footwear of claim 10, wherein each groove of the plurality of grooves extends longitudinally along the outsole.

13. The article of footwear of claim 1, wherein the midsole includes a first midsole portion extending from a rear of the upper to a midfoot portion of the upper, and a second midsole portion extending from a front of the upper to the midfoot portion of the upper.

14. The article of footwear of claim 13, wherein the support assembly is positioned beneath the first midsole portion.

15. An article of footwear, comprising:

an upper;

a midsole positioned beneath the upper; and a support assembly positioned beneath the midsole and comprising:

a first primary support member extending transversely and continuously across the support assembly, the first primary support member having one of a substantially Z-shaped cross-section and a substantially S-shaped cross-section, a second primary support member extending transversely and continuously across the support assembly, the second primary support member having one of a substantially Z-shaped cross-section and a substantially S-shaped cross-section and spaced forward from the first primary support member, a first secondary support member having an inverted V-shaped cross-section extending longitudinally and continuously along the support assembly, wherein the first secondary support member intersects each of the first primary support member and the second primary support member, and a second secondary support member having an inverted V-shaped cross-section extending longitudinally and continuously along the support assembly and spaced from the first secondary support member, wherein the second secondary support member intersects each of the first primary support member and the second primary support member.

16. The article of footwear according to claim 15, wherein the support assembly is formed as a unitary, one-piece construction from a single material.

17. The article of footwear according to claim 15, wherein each of the first primary support member, the second primary support member, the first secondary support member, and the second secondary support member is formed from a material selected from a group of materials consisting of: a polyether-block co-polyamide polymer, rubber, thermoplastic polyurethane, a nylon, and a fiber-filled nylon.

18. The article of footwear according to claim 15, wherein the first primary support member and the second primary support member extend substantially parallel to one another laterally across the support assembly.

19. The article of footwear according to claim 15, wherein the first secondary support member and the second secondary support member extend substantially parallel to one another longitudinally along the support assembly.

* * * * *